US009298129B2

(12) United States Patent
Sato et al.

(10) Patent No.: US 9,298,129 B2
(45) Date of Patent: Mar. 29, 2016

(54) DEVELOPING APPARATUS HAVING THICKNESS REGULATING MEMBER, SEALING MEMBER, AND RESTRICTING MEMBER

(71) Applicant: BROTHER KOGYO KABUSHIKI KAISHA, Nagoya-shi, Aichi-ken (JP)

(72) Inventors: Shougo Sato, Seto (JP); Fan Xu, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/541,243

(22) Filed: Nov. 14, 2014

(65) Prior Publication Data

US 2015/0078789 A1 Mar. 19, 2015

Related U.S. Application Data

(63) Continuation of application No. 13/560,646, filed on Jul. 27, 2012, now Pat. No. 8,892,011.

(30) Foreign Application Priority Data

Jul. 29, 2011 (JP) ..... 2011-167377
Jul. 29, 2011 (JP) ..... 2011-167378

(51) Int. Cl.
*G03G 15/08* (2006.01)

(52) U.S. Cl.
CPC ..... *G03G 15/0812* (2013.01); *G03G 15/0815* (2013.01); *G03G 15/0817* (2013.01); *G03G 15/0898* (2013.01); *G03G 15/0808* (2013.01)

(58) Field of Classification Search
CPC ..... G03G 15/0808; G03G 15/0812; G03G 15/0817; G03G 15/0898; G03G 15/0813; G03G 15/0815
USPC ..... 399/103, 105, 281, 284, 285
See application file for complete search history.

(56) References Cited

U.S. PATENT DOCUMENTS 5,628,043 A 5/1997 Ikeda et al.
5,752,146 A 5/1998 Sato
(Continued)

FOREIGN PATENT DOCUMENTS

JP 4-3188 A 1/1992
JP H06-301290 A 10/1994
(Continued)

OTHER PUBLICATIONS

Office Action issued in related Japanese Patent Application No. 2011-167377, mailed May 12, 2015 (7 pages).
(Continued)

*Primary Examiner* — David Gray
*Assistant Examiner* — Laura Roth
(74) *Attorney, Agent, or Firm* — Merchant & Gould P.C.

(57) ABSTRACT

In a developing apparatus, a sealing member has a first part contacting an axial end part of a developing roller and a second part including a first side surface. A roller body of a supply roller includes a contact surface that contacts the peripheral surface, and a second side surface located at an end of the contact surface in the axial direction. The restricting member has a one side and another side. The one side is opposed to the second side surface in the axial direction. The another side is opposed to the first side surface in the axial direction with a gap. The gap is communicated with an interior space of a developer accommodating frame such that the developer is capable of moving away from a nip position between the supply roller and the developing roller toward the bottom wall of the developing frame in the gap.

12 Claims, 10 Drawing Sheets

(56) References Cited

U.S. PATENT DOCUMENTS

| | | | |
|---|---|---|---|
| 6,336,014 | B1 | 1/2002 | Sato et al. |
| 6,360,068 | B1 | 3/2002 | Kinoshita et al. |
| 6,463,246 | B1 | 10/2002 | Mizuno et al. |
| 2006/0239724 | A1 | 10/2006 | Fuwazaki et al. |
| 2009/0035028 | A1 | 2/2009 | Itabashi |
| 2009/0196659 | A1 | 8/2009 | Handa |
| 2011/0103843 | A1 | 5/2011 | Sato |
| 2011/0158698 | A1 | 6/2011 | Sato |
| 2011/0200353 | A1 | 8/2011 | Kubo et al. |

FOREIGN PATENT DOCUMENTS

| | | | | |
|---|---|---|---|---|
| JP | 7-140784 | A | | 6/1995 |
| JP | H07-281518 | A | | 10/1995 |
| JP | H09-329960 | A | | 12/1997 |
| JP | 2001-42641 | A | | 2/2001 |
| JP | 2001-060041 | A | | 3/2001 |
| JP | 2001-92248 | A | | 4/2001 |
| JP | 2001-147585 | A | | 5/2001 |
| JP | 2005308860 | A | * | 11/2005 |
| JP | 2006-301481 | A | | 11/2006 |
| JP | 2009-031783 | A | | 2/2009 |
| JP | 2009-186661 | A | | 8/2009 |
| JP | 2011-28086 | A | | 2/2011 |
| JP | 2011-095461 | A | | 5/2011 |
| JP | 2011-133733 | A | | 7/2011 |
| JP | 2012048135 | A | * | 3/2012 |

OTHER PUBLICATIONS

Office Action issued in related Japanese Patent Application No. 2011-167378, mailed May 12, 2015 (5 pages).

* cited by examiner

DEVELOPING APPARATUS HAVING THICKNESS REGULATING MEMBER, SEALING MEMBER, AND RESTRICTING MEMBER

CROSS REFERENCE TO RELATED APPLICATION

This application is a continuation of U.S. patent application Ser. No. 13/560,646, filed Jul. 27, 2012, which claims priority from Japanese Patent Application No. 2011-167377 filed Jul. 29, 2011 and Japanese Patent Application No. 2011-167378 filed Jul. 29, 2011. The entire contents of the priority applications are incorporated herein by reference.

TECHNICAL FIELD

The present invention relates to a developing apparatus mounted to an electrographic image forming apparatus and a developing method using the developing apparatus.

BACKGROUND

There is known, as an electrographic printer, a printer provided with a photosensitive member and a developing apparatus that supplies the photosensitive member with toner.

One such a developing apparatus mounted to a printer include a developing roller that carries the toner, a supply roller that supplies the developing roller with the toner, and a layer-thickness regulating blade that regulates thickness of the toner on the developing roller to a predetermined value.

In this developing apparatus, the layer-thickness regulating blade includes a support portion made of iron or stainless steel, a plate spring attached to a distal end of the support portion, and a semicylindrical pressing member formed of silicone rubber and provided on the plate spring. The layer-thickness regulating blade is brought into contact with the developing roller at a curved part of the pressing member.

Further, in this developing apparatus, the side end of a side seal slides the side end surface of the supply roller.

SUMMARY

In the above developing apparatus, additional toner may be deposited on toner that is directly carried on a surface of the developing roller.

In this state, the additional toner is carried on the developing roller though the toner directly carried on the surface of the developing roller, resulting in an insufficient image force of the additional toner.

Thus, when a peripheral velocity of the developing roller is increased so as to increase an image forming speed of the printer, the additional toner carried on the developing roller is disadvantageously separated from the surface of the developing roller by a centrifugal force of the developing roller.

An object of the present invention is to provide a developing apparatus capable of preventing a developer from being separated from the developing roller and thus increasing an image forming speed and a developing method using the developing apparatus.

Further, in the above developing apparatus, toner supplied to the contact part between the developing roller and the supply roller is not supported, is excluded from the contact part, and enters a space between the side seal and the developing roller. Especially, when the peripheral velocity of the developing roller is increased so as to increase the image forming speed of the printer, the toner is melted by the frictional heat between the developing roller and the side seal. By this frictional heat, the side seal is broken. The broken side seal no longer seals the end of the developing roller, and thus, the toner may be leaked.

Another object of the present invention is to provide a developing apparatus to prevent the toner from being leaked from an axial end of a developing roller.

In order to attain the above and other objects, the invention provides a developing apparatus. The developing apparatus includes a housing, a developing roller, a supply roller, a thickness regulating member, a sealing member, and a restricting member. The housing includes: a developer accommodating frame configured to accommodate developer; and a developing frame communicated with the developer accommodating frame. The developing frame includes a supply-roller accommodating part and a bottom wall. The developing roller rotatably is supported by the supply-roller accommodating part and has a peripheral surface configured to carry the developer. The peripheral surface extends in an axial direction and includes an axial end part. The supply roller is rotatably supported in the developing frame, contacts the developing roller at a nip position, and is configured to supply the toner to the developing roller. The supply roller is shorter than the developing roller. The thickness regulating member includes a contact member contacting the developing roller. The contact member is configured to regulate a thickness of the developer on the developing roller. The sealing member is located in the developing frame and has a first part contacting the axial end part and a second part including a first side surface. The restricting member is located in the developing frame. The supply roller includes a rotational shaft and a roller body. The rotational shaft extends in the axial direction, and has axial ends supported by the developing frame. The roller body includes: a contact surface that contacts the peripheral surface and covers the rotational shaft while exposing the both axial ends of the rotational shaft; and a second side surface located at an end of the contact surface in the axial direction. The restricting member has a one side and another side opposite to the one side. The one side of the restricting member is opposed to the second side surface of the supply roller in the axial direction. The another side of the restricting member is opposed to the first side surface in the axial direction with a gap. The gap is communicated with an interior space of the developer accommodating frame such that the developer is capable of moving away from the nip position toward the bottom wall in the gap.

According to another aspect, the present invention provides a developing apparatus. A developing apparatus includes a housing, a developing roller, a supply roller, and a thickness regulating member. The housing is configured to accommodate developer that includes developer particles having a mean volume diameter. The developing roller rotatably is supported in the housing and has a peripheral surface configured to carry the developer. The supply roller is rotatably supported in the housing, contacts the developing roller, and is configured to supply the toner to the developing roller. The thickness regulating member includes a contact member contacting the peripheral surface. The contact member is configured to regulate a thickness of the developer on the peripheral surface such that an average of the thickness of the developer on the peripheral surface becomes smaller than or equal to the mean volume diameter. The developing roller rotates in a rotational direction. The peripheral surface of the developing roller has a region. The contact member has a thickness being larger than a thickness of the developer on the region. The thickness of the developer on the region is larger than the mean volume diameter.

BRIEF DESCRIPTION OF THE DRAWINGS

The particular features and advantages of the invention as well as other objects will become apparent from the following description taken in connection with the accompanying drawings, in which:

FIG. 9(*b*) is a front view of a crankshaft shown in FIG. 9(*a*);

FIG. 10(*b*) is a front view of a slide member shown in FIG. 10(*a*).

DETAILED DESCRIPTION

1. Overall Configuration of Printer

Figure 1:
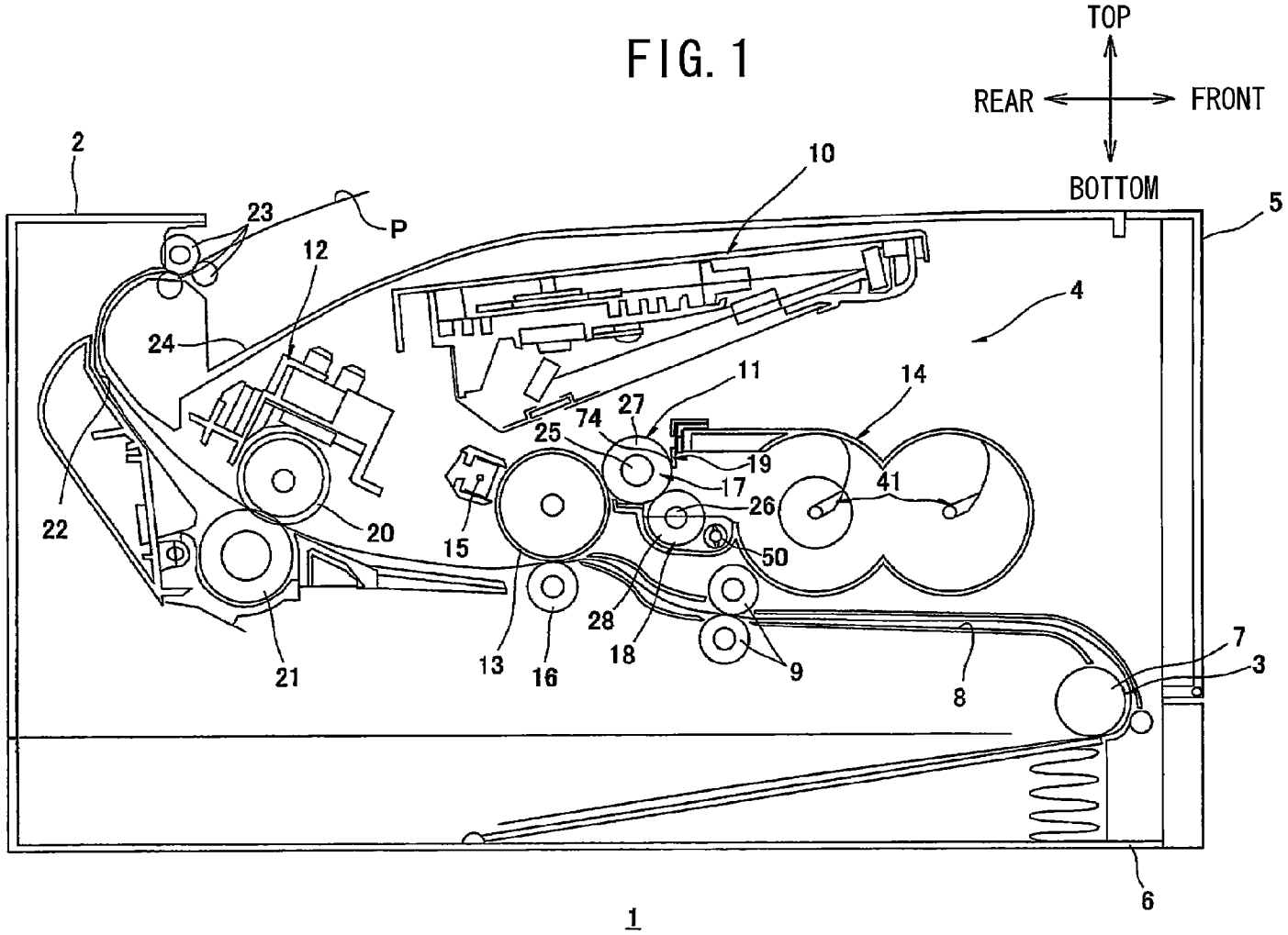
FIG. 1 is a cross section of a printer taken along a center thereof according to an embodiment of a present invention.

As illustrated in FIG. 1, a printer 1 includes a casing 2, a paper supply section 3 for supplying a paper P, and an image forming section 4 for forming an image onto the supplied paper P.

(1) Body Casing

The casing 2 is substantially formed into a box-shape in side view and accommodates the paper supply section 3 and image forming section 4. A front cover 5 is formed on one side wall of the casing 2 for mounting or removing a developing cartridge 14 (described later). The front cover 5 is provided so as to be swingable about a lower end portion thereof relative to the casing 2.

In the following description, a side (right side in FIG. 1) on which the front cover 5 is provided is defined as front side, and the opposite side (left side of FIG. 1) thereof is defined as rear side. Further, left-right direction is defined as viewed from the front side. That is, the near side of the paper surface of FIG. 1 is defined as left side, and the far side of the paper surface of FIG. 1 is defined as right side.

(2) Paper Supply Section

The paper supply section 3 is provided at a lower portion of the casing 2. The paper supply section 3 includes a paper supply tray 6 for storing the paper P and a pickup roller 7 provided on an upper portion of a front end portion of the paper supply tray 6. The paper supply section 3 further includes a paper supply path 8 extending rearward from an upper side of the pickup roller 7 and a pair of upper and lower registration rollers 9 arranged at a rear portion of the paper supply path 8.

The paper sheets P are stacked in the paper supply tray 6 and fed one by one starting from the topmost paper P by a rotation of the pickup roller 7. One paper P picked up by the pickup roller 7 is fed between the pair of registration rollers 9 through the paper supply path 8 and is then fed toward a portion between a photosensitive drum 13 (to be described later) and a transfer roller 16 (to be described later) at a predetermined timing.

(3) Image Forming Section

The image forming section 4 includes a scanner unit 10, a process unit 11, and a fixing unit 12.

(3-1) Scanner Unit

The scanner unit 10 is disposed at an upper portion of the casing 2. The scanner unit 10 emits laser beam toward a photosensitive drum 13 (to be described later) based on image data to expose the photosensitive drum 13.

(3-2) Process Cartridge (3-2-1) Configuration of Process Cartridge

The process unit 11 provided in the casing 2 is disposed below the scanner unit 10 and above the paper supply section 3 and includes the photosensitive drum 13 and the developing cartridge 14 that is detachably mounted to the front side of the photosensitive drum 13.

The photosensitive drum 13 is provided to extend along the left-right direction. A scorotron charger 15 and the transfer roller 16 are disposed around the photosensitive drum 13.

The scorotron charger 15 is disposed on the upper rear side of the photosensitive drum 13, and opposes the photosensitive drum 13 at a predetermined interval.

The transfer roller 16 is disposed below and opposes the photosensitive drum 13. The transfer roller 16 is brought into pressing contact with the photosensitive drum 13 from below.

The developing cartridge 14 includes a developing roller 17. The developing roller 17 extends in the left-right direction, and is rotatably supported at a rear end portion of the developing cartridge 14 such that the rear side of the developing cartridge 14 is exposed. The developing roller 17 is brought into pressing contact with the photosensitive drum 13 from the front side. The developing roller 17 includes a metal developing roller shaft 25 and a resin developing roller body 27. The developing roller body 27 covers the surface of the developing roller shaft 25 while exposing both end portions of the developing roller shaft 25 in the left-right direction. A negative developing bias is applied to the developing roller 17 from a power supply (not shown) in the casing 2.

The developing cartridge 14 includes a supply roller 18 that supplies the developing roller 17 with toner and a layer-thickness regulating blade 19 that regulates thickness of the toner supplied to the developing roller 17. The toner, specifically non-magnetic one-component spherical toner, is contained in a front space (toner accommodating frame 32 (to be described later)) relative to the supply roller 18 and the layer-thickness regulating blade 19.

To obtain the spherical toner, a resin solution containing a binder resin such as a polyester resin and a colorant such as carbon black is emulsified in water to prepare a dispersion liquid of resin fine particles, and thereafter the resin fine particles are subjected to condensation and fusion reaction.

A mean volume particle diameter of the spherical toner is, in terms of median size, e.g., 3 μm to 12 μm, preferably, 6 μm to 10 μm. That is, the mean volume particle diameter is a median value of the diameters of the particles weighted by the volumes of the particles. The mean volume particle diameter can be measured using, e.g., a Nanotrac particle size distribution measuring apparatus (UPA150 manufactured by Nikkiso Co., Ltd). In this measurement, refractive index of a solvent may be set to 1.33, and refractive index of a dispersion to 1.9.

(3-2-3) Developing Operation in Process Cartridge

The toner in the developing cartridge 14 is supplied to the supply roller 18 and then to the developing roller 17. Then, the toner is friction-charged to a positive polarity at a nip N1 (see FIG. 2) between the supply roller 18 and developing roller 17.

The toner supplied to the developing roller 17 is regulated in thickness by the layer-thickness regulating blade 19 with a rotation of the developing roller 17, and is carried on the surface of the developing roller 17 as a toner layer TL (see FIG. 2) having a certain thickness.

The surface of the photosensitive drum 13 is uniformly positively charged by the scorotron charger 15 with a rotation of the photosensitive drum 13 and is thereafter exposed by high-speed scanning of laser beam emitted from the scanner unit 10. As a result, an electrostatic latent image corresponding to an image to be formed onto the paper P is formed on the surface of the photosensitive drum 13.

Further, when the photosensitive drum 13 rotates, the positively charged toner carried on the surface of the developing roller 17 is supplied to the electrostatic latent image formed on the surface of the photosensitive drum 13. As a result, the electrostatic latent image on the photosensitive drum 13 is visualized, and a toner image based on reversal development is carried on the surface of the photosensitive drum 13.

When the paper P is passed between the photosensitive drum 13 and the transfer roller 16, the toner image carried on the photosensitive drum 13 is transferred onto the paper P.

(3-3) Fixing Unit

The fixing unit 12 is disposed at the rear of the process unit 11 and includes a heating roller 20 and a pressure roller 21 opposing to the heating roller 20. The toner image transferred onto the paper P in the process unit 11 is thermally fixed onto the paper P by heat and pressure while being passed between the heating roller 20 and the pressure roller 21.

(4) Paper Discharge Section

The paper P onto which the toner image has been fixed is passed through a paper discharge path 22 toward a paper discharge roller 23. Thereafter, the paper P is discharged by the paper discharge roller 23 on a paper discharge tray 24 provided above the scanner unit 10.

2. Details of Developing Cartridge (1) Cartridge Frame

Figure 2:
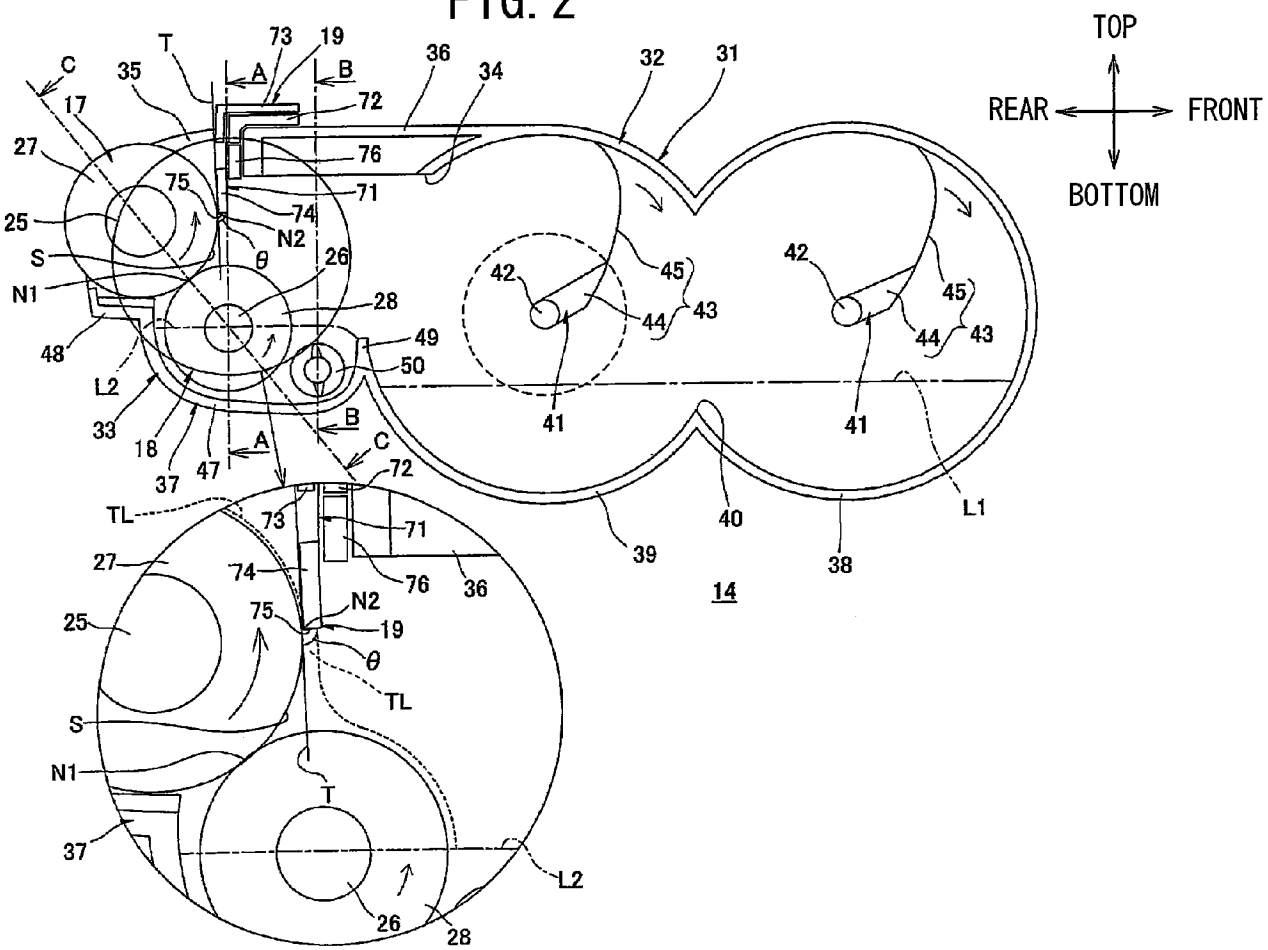
FIG. 2 is a cross section of a developer cartridge shown in FIG. 2.

As illustrated in FIG. 2, the developing cartridge 14 includes a cartridge frame 31 as an example of a casing.

The cartridge frame 31 includes a toner accommodating frame 32 in which the toner is stored and a developing frame 33 that supports the developing roller 17.

The toner accommodating frame 32 constitutes a front part of the cartridge frame 31 and is formed into a double cylindrical shape formed by joining two cylinders arranged in the radial direction thereof. More specifically, the toner accommodating frame 32 includes a first toner accommodating frame 38 and a second toner accommodating frame 39.

The first toner accommodating frame 38 is a front side cylindrical portion of the toner accommodating frame 32 and is formed substantially into a cylindrical shape whose left and right ends are closed.

The second toner accommodating frame 39 is a rear side cylindrical portion of the toner accommodating frame 32 and is formed substantially into a cylindrical shape whose left and right ends are closed. The second toner accommodating frame 39 is connected to a rear end portion of the first toner accommodating frame 38.

The toner accommodating frame 32 is formed with a first communication port 40 for passing the toner in the first toner accommodating frame 38 to the second toner accommodating frame 39 at a position between the first and second toner accommodating frames 38 and 39.

Further, the second toner accommodating frame 39 is formed with a second communication port 34 at a rear end thereof for passing the toner in the second toner accommodating frame 39 to the developing frame 33.

The second toner accommodating frame includes a partition wall 49 positioned below the second communication port 34. The partition wall 49 extends in the vertical direction for partitioning the second toner accommodating frame 39 and the developing frame 33. The upper end portion of the partition wall 49 is disposed below the nip N1.

An upper end edge of the partition wall 49 is disposed below a center axial line of a supply roller shaft 26 (described later). Thus, the upper end edge of the partition wall 49 is disposed below the nip N1 between the developing roller 17 and the supply roller 18. Further, both end portions of the partition wall 49 in the left-right direction are formed so as to be inclined downward toward outside with respect to the left-right direction (see a broken line of FIG. 5).

An agitator 41 is provided in each of the first and second toner accommodating frames 38 and 39 of the toner accommodating frame 32.

Figure 3:
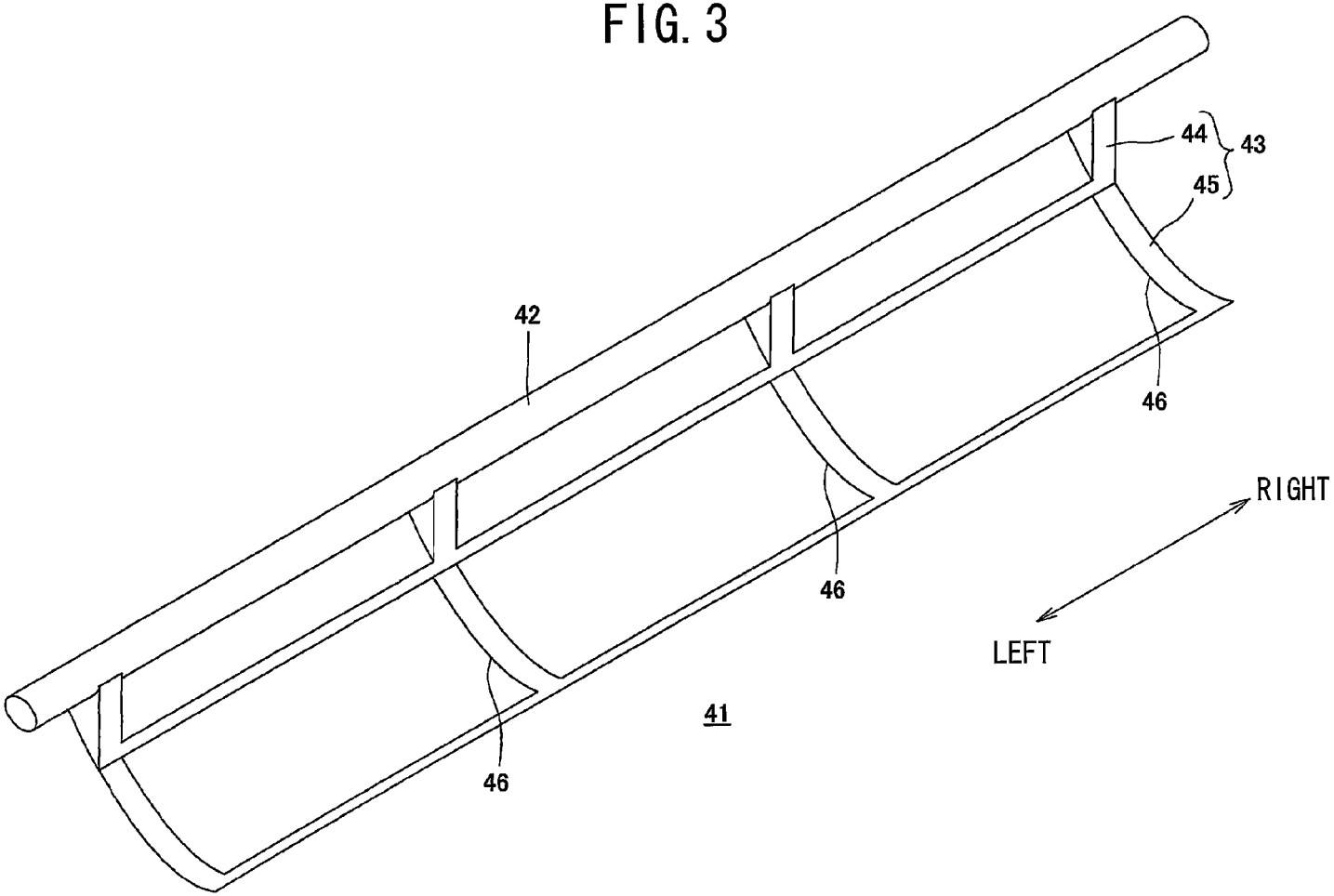
FIG. 3 is a perspective view of an agitator shown in FIG. 2 seeing from upper left side.

As shown in FIGS. 2 and 3, the agitator 41 includes an agitator shaft 42 extending in the left-right direction and an agitating blade 43 supported by the agitator shaft 42.

The agitator shaft 42 is formed substantially into a columnar shape extending in the left-right direction.

The agitator blade 43 includes a support portion 44 and an agitating portion 45.

The support portion 44 is formed substantially into a wedge shape in side view protruding outside of the agitator shaft 42 in the radial direction (hereinafter, referred to as "outside in the radial direction") from the agitator shaft 42 and extending in the left-right direction.

The agitating portion 45 is formed of an elastic resin film and is substantially formed in a plate shape extending outside in the radial direction from an outside end portion of the support portion 44 in the radial direction so as to curve toward in an upstream side of the agitator 41 in the rotational direction (hereinafter, referred to as "upstream side in the rotational direction"). The agitating portion 45 has three openings 46 (FIG. 3).

The openings 46 are arranged, side by side, in the left-right direction with a predetermined interval provided therebetween and each is substantially formed in a rectangular shape that is formed by penetrating the resin film.

The end portions of each agitator 41 in the left-right direction are rotatably supported by the left and right side walls of corresponding one of the first and second toner accommodating frames 38 and 39.

Figure 4:
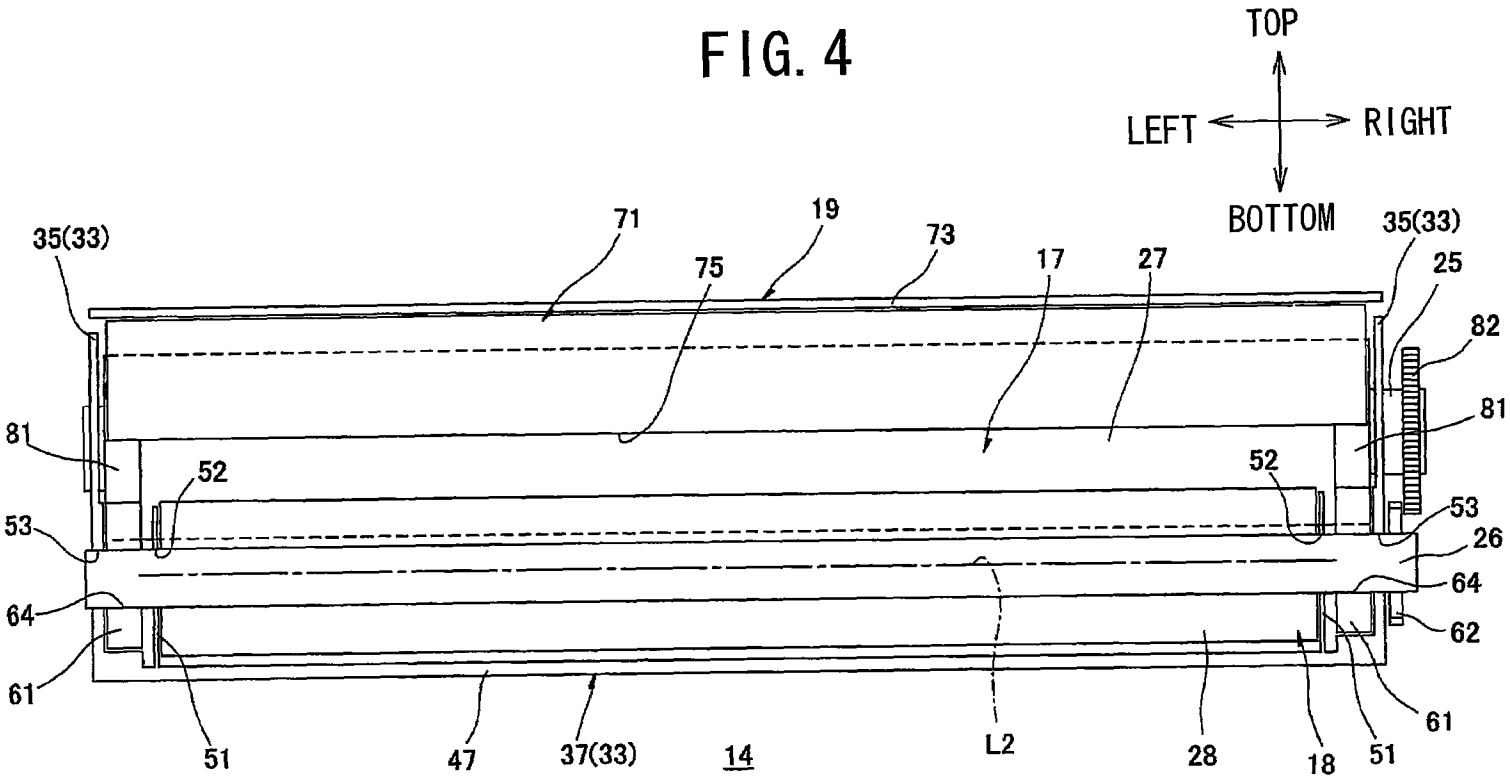
FIG. 4 is a cross section of the developer cartridge taken along a line A-A shown in FIG. 2.
Figure 5:
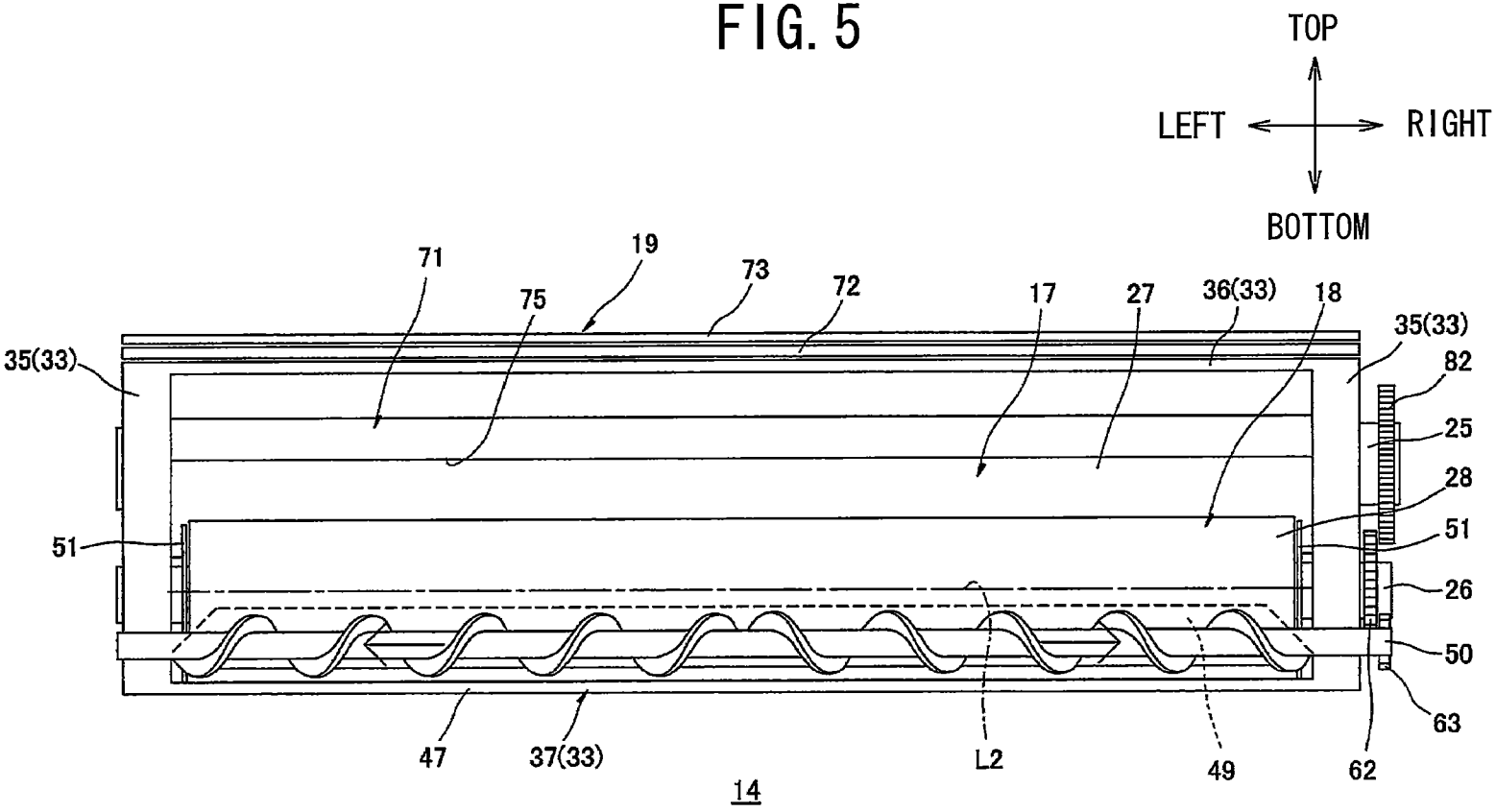
FIG. 5 is a cross section of the developer cartridge taken along a line B-B shown in FIG. 2.

As shown in FIGS. 2, 4, and 5, the developing frame 33 is formed continuously from a rear end portion of the toner accommodating frame 32 and includes a pair of left and right side walls 35, an upper wall 36, and a lower wall 37.

The left and right side walls 35 are formed into substantially plate shapes extending rearward continuously from the respective left and right side walls of the second toner accommodating frame 39. A supply roller shaft support hole 53 is formed so as to penetrate each of the side walls 35. The supply roller shaft 26 is inserted through the supply roller shaft support hole 53.

The upper wall 36 is formed into substantially a plate shape extending rearward continuously from an upper end portion of the second toner accommodating frame 39. The upper wall 36 bridges upper end portions of the side walls 35. A rear end portion of the upper wall 36 is disposed frontward of rear end portions of the side walls 35.

The lower wall 37 extends rearward continuously from a lower end portion of the second toner accommodating frame 39. The lower wall 37 bridges lower end portions of the side walls 35. The lower wall 37 includes a supply roller housing portion 47 for housing the supply roller 18 and a receiving portion 48 disposed below the developing roller 17.

The supply roller housing portion 47 is substantially U-shaped opened upward in cross section and is continuously formed from the partition wall 49 of the second toner accommodating frame 39. When projected in the front-rear direction, an upper end of the supply roller housing portion 47 at its rear end is disposed above the upper end of the partition wall 49.

A pair of left and right restricting walls 51 are provided in the supply roller housing portion 47 (see FIG. 4).

The both restricting walls 51 are disposed inside of the both side walls 35 with respect to the left-right direction while opposing corresponding end of a supply roller body 28 (to be described later) in the left-right direction. A supply roller shaft insertion holes 52 are formed by penetrating the restricting walls 51. The supply roller shaft 26 (to be described later) is inserted through the supply roller shaft insertion holes 52.

The receiving portion 48 is formed substantially in a plate extending rearward from the upper rear end portion of the supply roller housing portion 47. When projected in the vertical direction, a rear end of the receiving portion 48 is disposed rearward of the rear end of the upper wall 36 and substantially flush with the rear ends of the side walls 35.

(2) Supporting Supply Roller in Cartridge Frame

Figure 6:
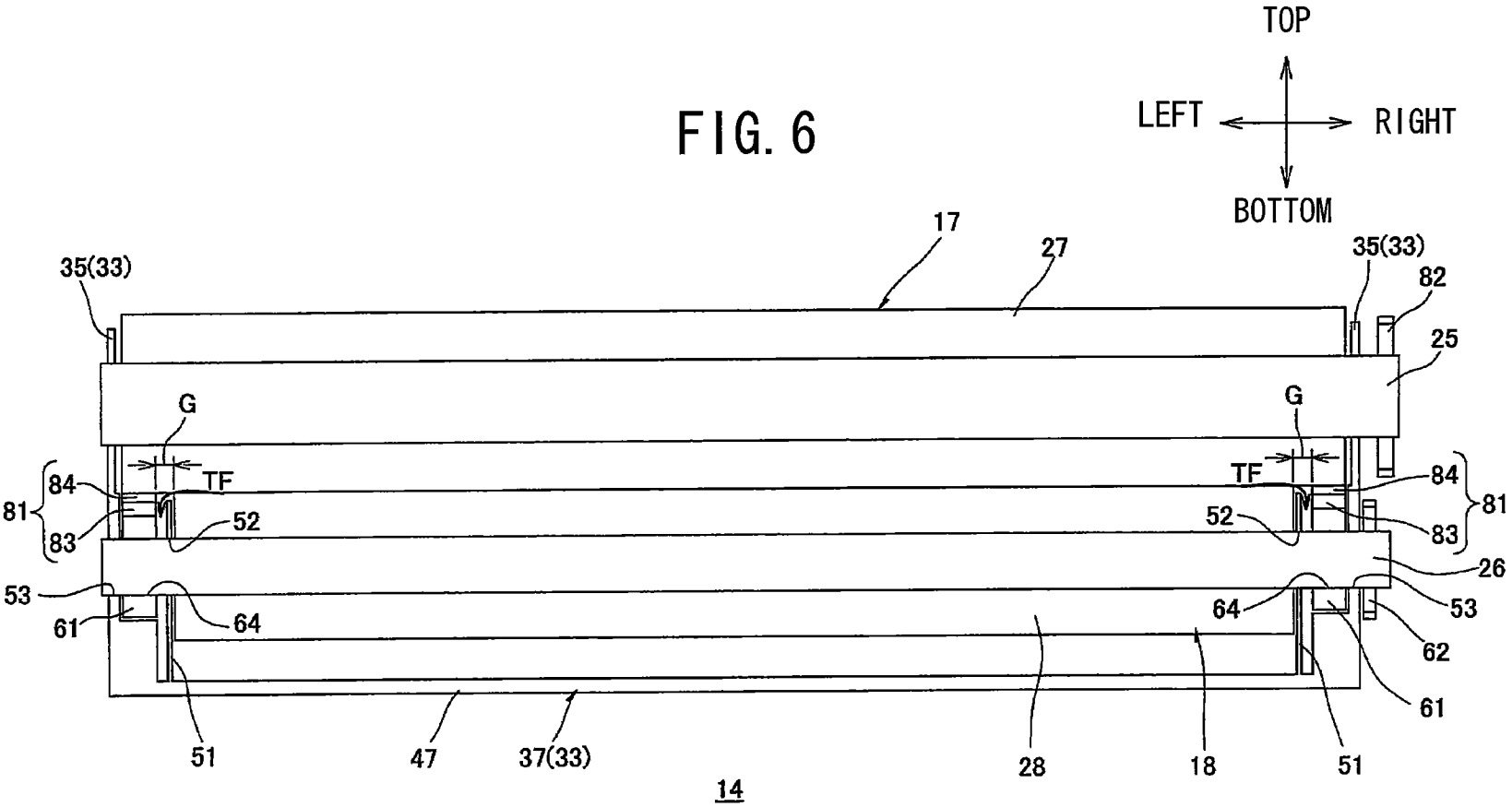
FIG. 6 is a cross section of the developer cartridge taken along a line C-C shown in FIG. 2.

As shown in FIGS. 2, 4, and 6, the supply roller 18 includes the metal supply roller shaft 26 and a resin supply roller body 28. The resin supply body 28 covers the surface of the supply roller shaft 26 while exposing both end portions of the supply roller shaft 26 in the left-right direction. The length of the supply roller body 28 in left-right direction is shorter than that of the developing roller body 27.

The supply roller 18 is accommodated in a front end portion of the supply roller housing portion 47 such that end portions of the supply roller shaft 26 in the left-right direction are inserted through the supply roller shaft insertion holes 52 of the restricting walls 51 and are rotatably supported in the supply roller shaft support holes 53.

Two shaft seals 61 (FIG. 4) are fit on end portions of the supply roller shaft 26 in the left-right direction. Each shaft seal 61 is disposed between the corresponding restricting wall 51 and side wall 35. Further, a supply roller drive gear 62 is provided at a right end portion of the supply roller shaft 26.

The shaft seal 61 is formed of resin foam and is substantially formed in a plate shape having a thickness in the left-right direction. A supply roller shaft insertion hole 64 is formed so as to penetrate the shaft seal 61. The supply roller shaft insertion hole 64 has a diameter slightly smaller than the diameter of the supply roller shaft 26. The supply roller shaft 26 is inserted through the supply roller shaft insertion hole 64.

The supply roller drive gear 62 is disposed on the right side of the right side wall 35 and supported at the right end portion of the supply roller shaft 26 so as not to be relatively rotated. The supply roller drive gear 62 is engaged with a developing coupling (not shown) rotatably mounted to a right wall of the cartridge frame 31. The supply roller drive gear 62 transmits, to the supply roller shaft 26, a drive force input from the casing 2 to the developing coupling (not shown).

As shown in FIGS. 2 and 5, an auger screw 50 *a* is provided in the supply roller housing portion 47 and disposed at a position between the partition wall 49 and the supply roller 18.

The auger screw 50 extends in the left-right direction and has a smaller diameter than the diameter of the supply roller 18. The auger screw 50 is rotatably provided in the supply roller housing portion 47 such that an upper end of the auger screw 50 is disposed below the upper end of the partition wall 49. An auger drive gear 63 (see FIG. 5) is provided at a right end portion of the auger screw 50.

The auger drive gear 63 is disposed on the right side of the right side wall 35 and supported at the right end portion of the auger screw 50 so as not to be relatively rotated. The auger drive gear 63 is engaged with the developing coupling (not shown) and transmits, to the auger screw 50, a drive force input from the casing 2 to the developing coupling (not shown). The toner is accumulated in the supply roller housing portion 47 at a portion above the upper end portion of the auger screw 50.

(3) Supporting Developing Roller in Cartridge Frame

As shown in FIGS. 2 and 6, the developing roller 17 is disposed above the receiving portion 48 such that end portions of the developing roller shaft 25 in the left-right direction are rotatably supported by the side walls 35 and that the developing roller body 27 is brought into contact with the supply roller body 28 from the upper rear side thereof.

A developing roller drive gear 82 is provided at a right end portion of the developing roller shaft 25. Further, two side seals 81 (see FIG. 4) are brought into contact with end portions (end surfaces) of the developing roller body 27 in the left-right direction.

The developing roller drive gear 82 is disposed on the right side of the right side wall 35 and supported at the right end portion of the developing roller shaft 25 so as not to be relatively rotated. The developing roller drive gear 82 is engaged with the developing coupling (not shown). The developing roller drive gear 82 transmits, to the developing roller shaft 25, a drive force input from the casing 2 to the developing coupling (not illustrated).

As shown in FIG. 6, each side seal 81 is substantially formed a plate shape having flexibility which is obtained by laminating a foam layer 83 formed of resin foam and a felt layer 84 formed of non-woven cloth. Each side seal 81 is supported inside the developing frame 33 and is brought into contact with the developing roller body 27 from the lower front side of the developing roller 17 so as to follow the peripheral surface of the developing roller body 27. Further, each side seal 81 is disposed on outside of the outer end of the supply roller body 28 in the left-right direction and disposed on outside of the restricting wall 51 in the left-right direction. That is, each side seal 81 is separated from the corresponding side surface of the supply roller body 28 in the left-right direction. The inner surface of each side seal 81 is separated from the corresponding restricting wall 51 with a gap G in the left-right direction. That is, a space TG is formed between each side seal 81 and the corresponding restricting wall 51.

(4) Supporting Layer-Thickness Regulating Blade in Cartridge Frame

As shown in FIGS. 2 and 4, the layer-thickness regulating blade 19 is supported at a rear end portion of the upper wall 36 of the developing frame 33 by screws (not shown). The layer-thickness regulating blade 19 includes a blade member 71 to be brought into contact with the developing roller 17 and first and second support members 72 and 73 that support the blade member 71.

The blade member 71 is formed of an elastic thin metal plate and is substantially formed in a rectangular plate shape in front view extending in both the vertical direction and the left-right direction. An contacting member 74 is provided on the rear surface of the lower end portion of the blade member 71. The contacting member 74 contacts the peripheral surface of the developing roller body 27

The contacting member 74 is formed of a conductive resin and is substantially in a rectangular plate shape in cross section having a thickness in the front-rear direction. A lower surface 75 of the contacting member 74 extends in the front-rear direction.

The first support member 72 is formed of a metal plate having a thickness larger than the thickness of the blade member 71. The first support member 72 is substantially L-plate shaped in cross section. That is, the first support member 72 extends in the front-rear direction and is bent downward at its rear end portion.

The second support member 73 is formed of a metal plate having a thickness larger than the thickness of the blade member 71. The second support member 73 is substantially L-plate shaped in cross section. That is, the second support member 73 extends in the front-rear direction, and is bent downward at its rear end portion. The second support member 73 is stacked on the first support member 72 from above in such that the rear end portion (downward bending portion) of the second support member 73 is opposed to the rear end portion of the first support member 72 from the rear side thereof.

An upper end portion of the blade member 71 is held between the rear end portion of the first support member 72 and the rear end portion of the second support member 73. A lower end portion of the contacting member 74, which is positioned above the supply roller 18, contacts a front end of the developing roller body 27 from the front side thereof.

An angle θ defined between a tangent line T and the lower surface 75 of the contacting member 74. Here, the tangent line T passes through a lower end edge of a nip N2 between the developing roller body 27 and contacting member 74. The angle θ is greater than or equal to 90°. The nip N1 is located below the nip N2.

A blade seal 76 is interposed between the blade member 71 and a rear surface of the developing frame 33.

The blade seal 76 is formed of resin foam and is substantially formed in a rectangular plate shape in cross section having a thickness in the front-rear direction.

3. Developing Operation

As shown in FIGS. 1 and 2, in a state where the developing cartridge 14 has been attached to the casing 2, toner level L1 in the toner accommodating frame 32 is below the upper end of the partition wall 49 when projected in the front-rear direction.

When the developing cartridge 14 is driven in an image forming operation, the agitators 41 in the toner accommodating frame 32 are each rotated clockwise as viewed from the left side as shown in FIG. 2. Further, both the developing roller 17 and the supply roller 18 are rotated counterclockwise as viewed from the left side. That is, the developing roller 17 is rotated such that the peripheral surface of the developing roller 17 passes upward through the point of the nip N2.

The rotation of the agitators 41 causes the toner in the first toner accommodating frame 38 to be supplied through the first communication port 40 to the second toner accommodating frame 39 and further causes the toner in the second toner accommodating frame 39 to be supplied through the second communication port 34 to the developing frame 33. An amount of the toner to be supplied to the developing frame 33 is controlled by the openings 46 (FIG. 3) of the agitating member 45 in order to prevent the amount of toner in the developing frame 33 from being excessively increased.

The toner supplied to the developing frame 33 is accumulated in the supply roller housing portion 47 to a level above the upper end portion of the partition wall 49.

The toner accumulated in the supply roller housing portion 47 is agitated by a rotation of the auger screw 50 and collected, by its own weight, into the second toner accommodating frame 39 through the space formed above the both end portions (see FIG. 5) of the partition wall 49 in the left-right direction.

Toner level L2 in the supply roller housing portion 47 is maintained near the level of a center axial line of the supply roller 18 by a balance between the toner supply amount from the second toner accommodating frame 39 to the developing frame 33 and the collection amount of the toner to be collected into the second toner accommodating frame 39 through the space formed above the both end portions (see FIG. 5) of the partition wall 49 in the left-right direction.

That is, the toner level L2 in the supply roller housing portion 47 is below the nip N2 between the contacting member 74 of the layer-thickness regulating blade 19 and the developing roller 17. The toner level L2 is also below the nip N1.

As described above, the toner in the supply roller housing portion 47 is supplied to the nip N1 between the supply roller 18 and the developing roller 17 by a rotation of the supply roller 18. Thus, the toner is friction-charged and carried on the surface of the developing roller 17.

Figure 7:
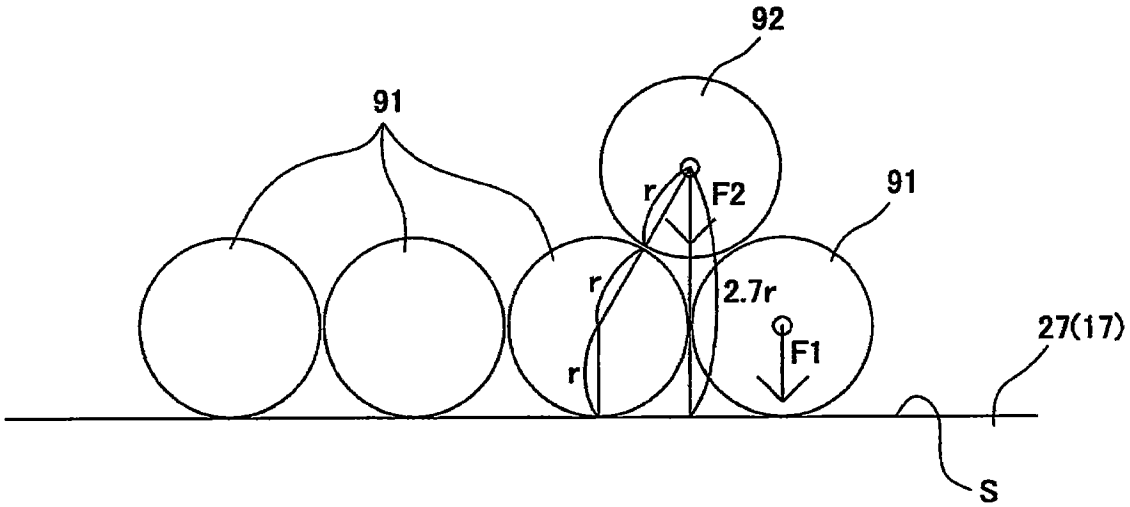
FIG. 7 is an explanatory diagram illustrating an image force of overlapped tonner particles.

At this time, as shown in FIG. 7, direct coating particles 91 and overlapping toner particles 92 are carried on a peripheral surface S of the developing roller 17. Specifically, the direct coating particles 91 directly contact the peripheral surface S, and the overlapping toner particles 92 is stacked (overlapped) on the direct coating toner particles 91.

A thickness of a toner later TL (see FIG. 2) carried on the developing roller 17 is smaller than the thickness of the contacting member 74 but exceeds the mean volume particle diameter of the toner. Specifically, the contacting member 74 has a thickness larger than the thickness of the toner TL on the developing roller 17 in a region on the developing roller 17 upstream of the nip N2 in the rotational direction.

Assuming that charges of the toner particles (the direct coating toner particles 91 and the overlapping toner particles 92) are almost equal, an image force F of each toner particle with respect to the surface S is inversely proportional to the square of a distance between each toner particle and surface S.

That is, an image force F2 of the overlapping toner particle 92 with respect to the surface S is smaller than the image force F1 of the direct coating toner particle 91 with respect to the surface S.

More specifically, assuming that one overlapping toner particle 92 is carried on two adjacent direct coating toner particles 91, a distance between the overlapping toner particle 92 and the surface S is about 2.7 (just $1+\sqrt{3}$) times larger than a distance between the direct coating toner particles 91 and the surface S. Accordingly, the image force F2 of the overlapping toner particles 92 with respect to the surface S is about $1/7.3$ of the image force F1 of the direct coating toner particles 91 with respect to the surface S.

As shown in FIG. 2, the toner carried on the surface of the developing roller 17 is fed upward by a rotation of the developing roller 17 from the nip N1 between the supply roller 18 and the developing roller 17, and subsequently is brought into contact with the lower surface 75 of the contacting member 74 of the layer-thickness regulating blade 19 from the below.

When the developing roller 17 is further rotated, the overlapping toner particles 92 are restricted from entering the nip N2 between the developing roller 17 and the contacting member 74 by the lower surface 75 of the contacting member 74 and eventually separated from the surface S of the developing roller 17 against the image force F2.

The overlapping toner particles 92 separated from the surface S fall near the nip N1 between the supply roller 18 and the developing roller 17, and thus, the toner is accumulated near the contact portion N1 between the supply roller 18 and the developing roller 17. The toner level L1 in the toner accommodating frame 32 is lower than the toner level L2 in the supply roller housing portion 47, so that when the toner level L2 exceeds the partition wall 49, the toner accumulated near the nip N1 flows over the partition wall 49 and into the toner accommodating frame 32. This prevents the toner near the nip N1 from being excessively accumulated in a portion above the partition wall 49.

Further, although the toner that has flowed into the gap G between the supply roller 18 and the side seal 81 is likely to flow into a contact portion between the developing roller 17 and the side seal 81 due to a rotation of the end surface of the supply roller body 28, this inflow of the toner is prevented by the restricting wall 51 (see FIG. 4).

Further, although the overlapping toner particles 92 are separated from the surface S of the developing roller 17, the direct coating toner particles 91 are strongly adhered to the surface S of the developing roller 17 by the image force F 1 thereof. Thus, the direct coating toner particles 91 are not separated from the surface S but enter the nip N2 between the developing roller 17 and the contacting member 74.

As a result, almost only the direct coating toner particles 91 are left on the surface S of the developing roller 17, and the average value of the thickness of the toner layer TL on the downstream side relative to the nip N2 in the rotational direction becomes equal to or less than the mean volume particle diameter of the toner. That is, almost all particles contact directly on the surface S at the downstream side to the nip N2. In this case, when the average value of the thickness of the toner layer TL is precisely measured, the average value of the thickness of the toner layer TL becomes generally smaller than or equal to the mean volume particle diameter of the toner.

More specifically, the average value of the toner layer TL on the downstream side relative to the nip N2 in the rotational direction is, e.g., 3.5 μm to 7.0 μm, preferably, 4.5 μm to 6.0 μm.

The average value of the thickness of the toner layer TL can be measured by using a measuring apparatus capable of measuring a surface state in a non-contact manner, such as Ultra-deep color 3D profile measurement microscope VK-9500 manufactured by KEYENCE.

Thereafter, as described above, the toner carried on the surface of the developing roller 17 is supplied to the electrostatic latent image formed on the photosensitive drum 13 to develop the electrostatic latent image.

4. Operations and Effects (1) According to a developing method using the developing cartridge 14, as shown in FIG. 6, the average value of the thickness of the toner layer TL carried on the surface S of the developing roller 17 can be reduced to equal to or less than the mean volume particle diameter of the toner, that is, almost all the toner particles can be directly carried on the surface S of the developing roller 17.

This reduces the number of the overlapping toner particles 92 carried on the surface S of the developing roller 17 in an overlapping manner.

As a result, after the toner passes through the nip N2, separation of the toner from the developing roller 17 can be prevented, which in turn leads to an increase in the image forming speed.

(2) Further, according to a developing method using the developing cartridge 14, as shown in FIG. 2, the lower surface 75 of the contacting member 74 is brought into contact with the developing roller 17 so as to form an angle θ of equal to or more than 90° with respect to the tangent line T of the developing roller 17 that passes through the lower end edge of the nip N2.

That is, the contacting member 74 can contact the surface S of the developing roller 17 so as to scrape off the toner carried on the surface S of the developing roller 17.

As shown in FIG. 7, the overlapping toner particles 92 carried on the surface S in an overlapping manner is small in terms of image force F2 with respect to the surface S of the developing roller 17, so that the overlapping toner particles 92 are scraped off from the surface S of the developing roller 17 by the contacting member 74.

On the other hand, the direct coating toner particles 91 directly carried on the surface S of the developing roller 17 are strongly adhered to the surface S of the developing roller 17 by the image force F1, so that the direct coating toner particles 91 are not scraped off by the contacting member 74 but passed through the nip N2 between the contacting member 74 and the developing roller 17 while being carried on the surface S of the developing roller 17.

As a result, the number of the overlapping toner particles 92 can be reduced.

(3) Further, according to the developing cartridge 14, as shown in FIG. 2, the thickness of the toner layer TL on the lower side of the lower end portion of the contacting member 74 (on the upstream side of the developing roller 17 in the rotational direction) is smaller than the thickness of the contacting member 74.

Thus, the overlapping toner particles 92 can reliably be brought into contact with the lower surface 75 of the contacting member 74 and can be separated from the developing roller 17.

Further, the scraping-off of the toner by the contacting member 74 is likely to be insufficient when an excessive amount of toner is accumulated around the nip N2; however, this can completely be prevented by reducing the thickness of the toner layer TL.

(4) Further, according to a developing method using the developing cartridge 14, the contacting member 74 is formed of a conductive resin.

This can prevent the contacting member 74 from being charged with a reverse polarity (negative charge) to a toner polarity (positive charge) when being brought into (frictional) contact with the toner.

(5) Further, according to the developing cartridge 14, as shown in FIGS. 2 and 6, the both ends of the supply roller body 28 in the left-right direction are disposed spaced apart from the inner surfaces of the side seals 81 in the left-right direction. Further, the upper end portion of the partition wall 49 is disposed below the nip N1 between the developing roller 17 and the supply roller 18.

Thus, even if a part of the toner supplied to the nip N1 between the developing roller 17 and the supply roller 18 is not carried on the developing roller 17 but pushed outward in the left-right direction from the nip N1, the pushed toner can be collected in the supply roller housing portion 47 through gaps (the space TF in FIG. 6) between the end of the supply roller body 28 in the left-right direction and the inner surface of the side seals 81 in the left-right direction.

This can prevent the toner pushed outward in the left-right direction from the nip N1 from entering between the side seals 81 and the developing roller 17.

As a result, toner leakage from the end portions of the developing roller 17 in left-right direction can be prevented.

(6) Further, according to the developing cartridge 14, as shown in FIG. 5, the restricting walls 51 for restricting passage of the toner are provided between the end portions of the supply roller body 28 in the left-right direction and the side seals 81.

This configuration prevents a rotation of the end surfaces of the supply roller body 28 from influencing the toner that has entered the gaps G and restricts the toner from being passed to the contact portions between the developing roller 17 and the side seals 81 by a rotation of the end surfaces of the supply roller body 28. Thus, this configuration prevents an increase in the toner amount in the gaps between the ends of the supply roller body 28 in the left-right direction and the inner surfaces of the side seal 81 with respect to the left-right direction.

As a result, toner leakage from the both end portions of the developing roller 17 in the left-right direction can be further prevented.

(7) Further, according to the developing cartridge 14, as shown in FIG. 2, the toner in the supply roller housing portion 47 can be agitated by the auger screw 50 provided between the partition wall 49 and the supply roller 18.

Thus, even if the toner level L2 in the supply roller housing portion 47 is low, the toner can be supplied uniformly and stably to the supply roller 18.

(8) Further, according to the developing cartridge 14, as shown in FIG. 2, the toner is accumulated in the supply roller housing portion 47 at a portion above the upper end portion of the auger screw 50.

Thus, a variation in the toner level L2 in the supply roller housing portion 47 is prevented by a rotation of the auger screw 50, thereby stabilizing the toner level L2.

(9) Further, according to the developing cartridge 14, as shown in FIG. 2, the toner is accumulated in the supply roller housing portion 47 at a portion below the nip N1 between the developing roller 17 and the supply roller 18.

Thus, even if a part of the toner supplied to the nip N1 between the developing roller 17 and the supply roller 18 is not carried on the developing roller 17 but pushed outward in the left-right direction from the nip N1, the pushed toner can be made to fall for collection in the supply roller housing portion 47 through gaps between the end of the supply roller body 28 in the left-right direction and the inner surfaces of the side seals 81 in the left-right direction.

This configuration can prevent the toner pushed outward in the left-right direction from the nip N1 from entering between the side seals 81 and the developing roller 17.

As a result, toner leakage from the end portions of the developing roller 17 in the left-right direction can be prevented.

5. Modifications

While the invention has been described in detail with reference to the embodiments thereof, it would be apparent to those skilled in the art that various changes and modifications may be made therein without departing from the scope of the invention.

In the following modifications, the same reference numerals are given to the same parts as in the above embodiment, and the descriptions thereof will be omitted.

In the above embodiment, the toner in the supply roller housing portion 47 is agitated by the auger screw 50.

Figure 8:
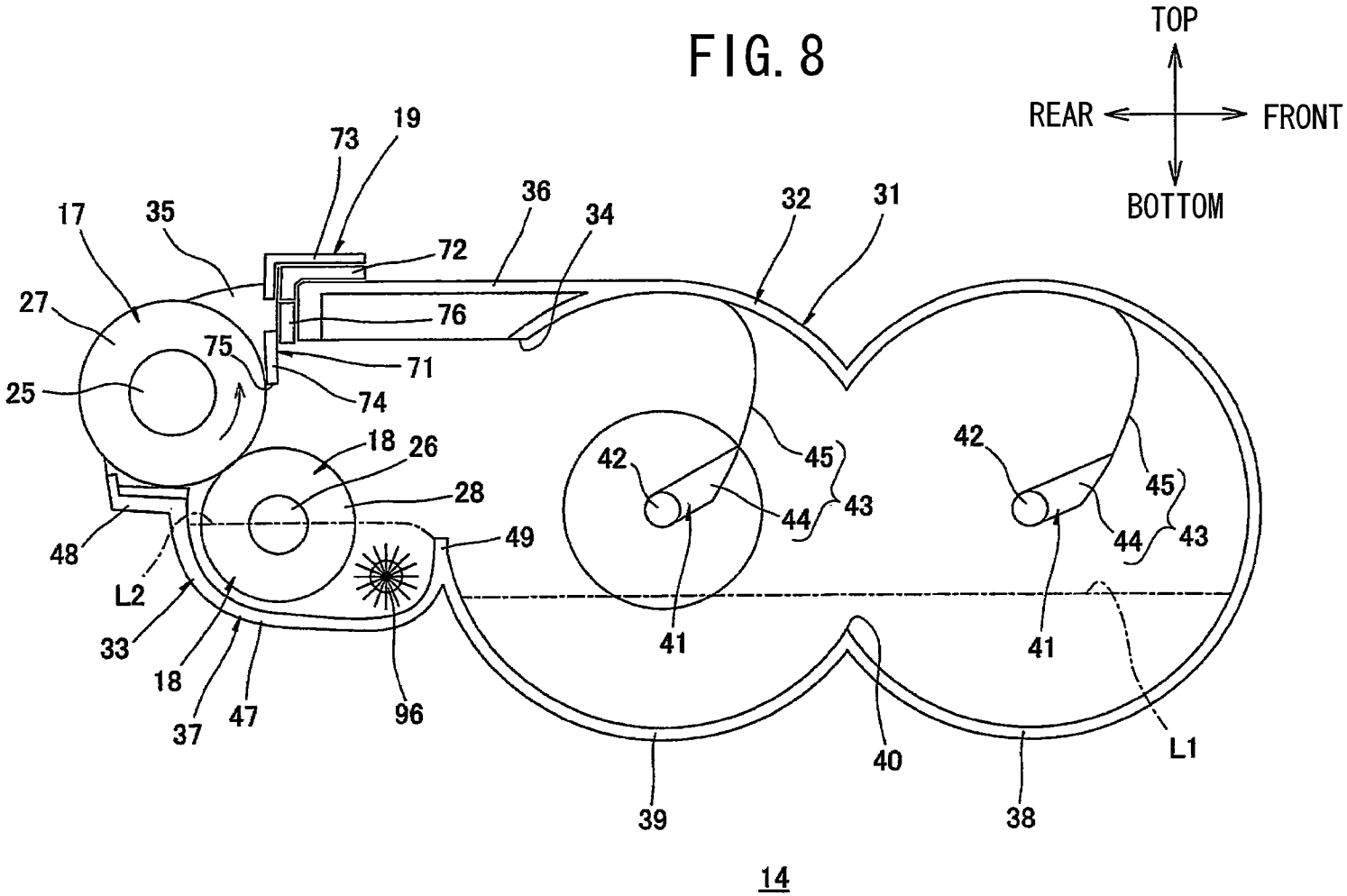
FIG. 8 is a side cross section of a developing cartridge according to a modification.

Alternatively, as shown in FIG. 8, a brush 96 is substantially formed in a columnar shape extending in the left-right direction may be used in place of the auger screw 50 to agitate the toner in the supply roller housing portion 47.

Figures 9A, 9B:
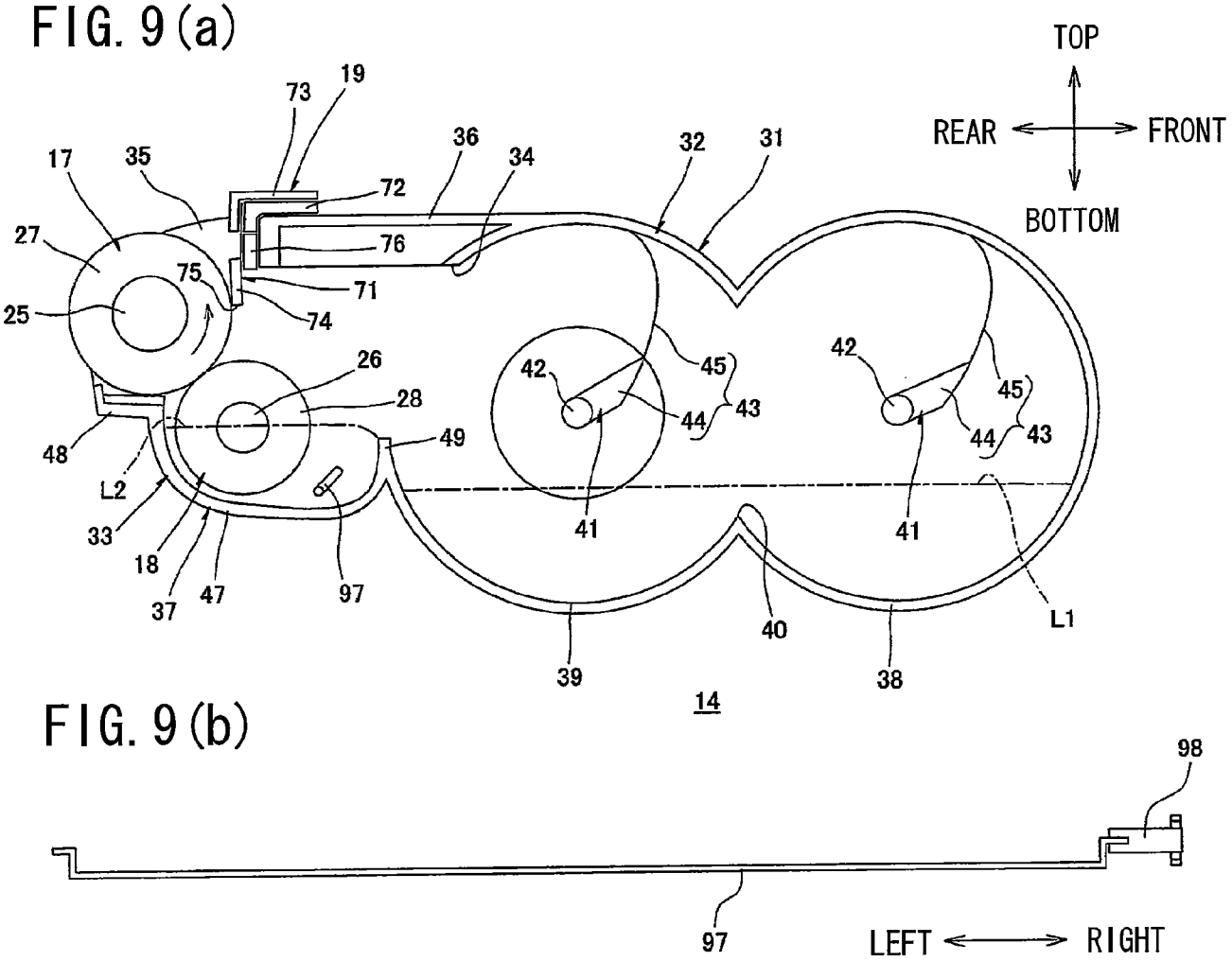
FIG. 9(*a*) is a side cross section of a developing cartridge according to a modification.

Further, as shown in FIGS. 9(*a*) and 9(*b*), a crankshaft 97 having a shape bent in a U-shape may be used in place of the auger screw 50 to agitate the toner in the supply roller housing portion 47. A shaft drive gear 98 for inputting a drive force to the crankshaft 97 is supported at a right end portion of the crankshaft 97 so as not to be relatively rotated.

Figure 10A:
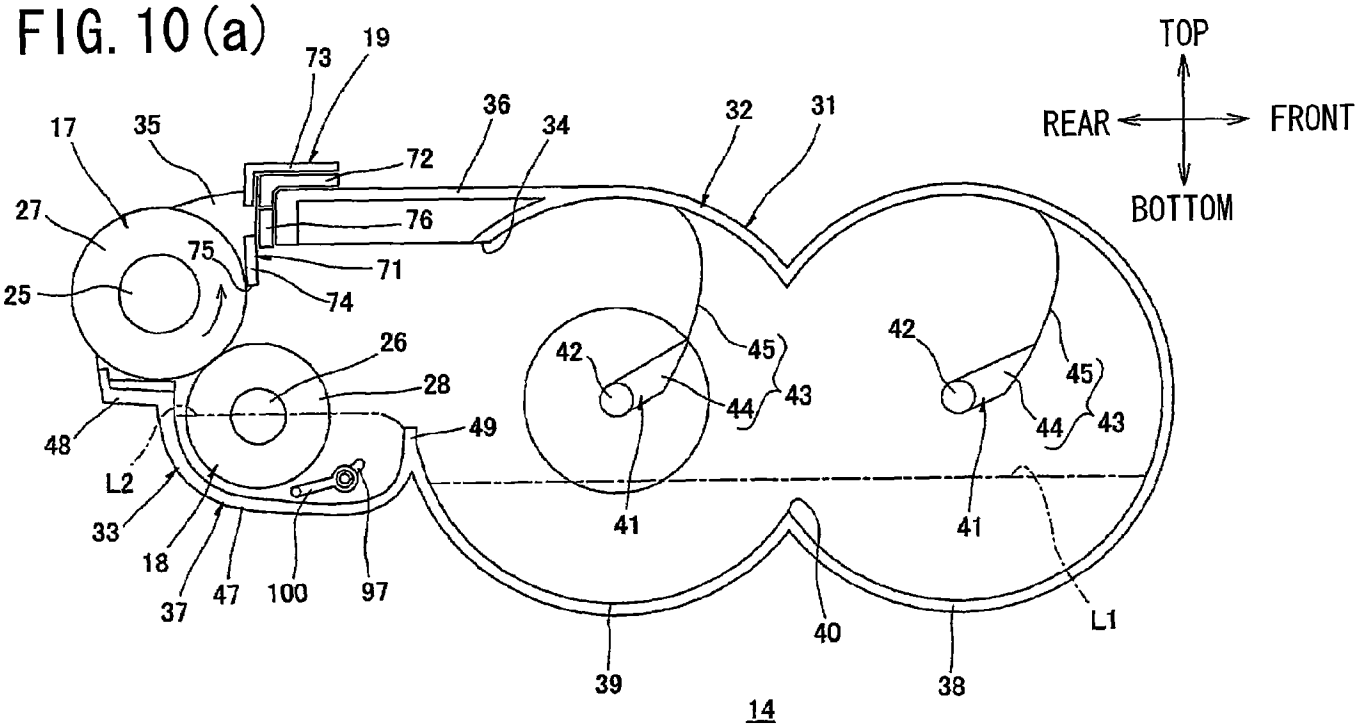
FIG. 10(*a*) is a side cross section of a developing cartridge according to a modification.
Figure 10B:
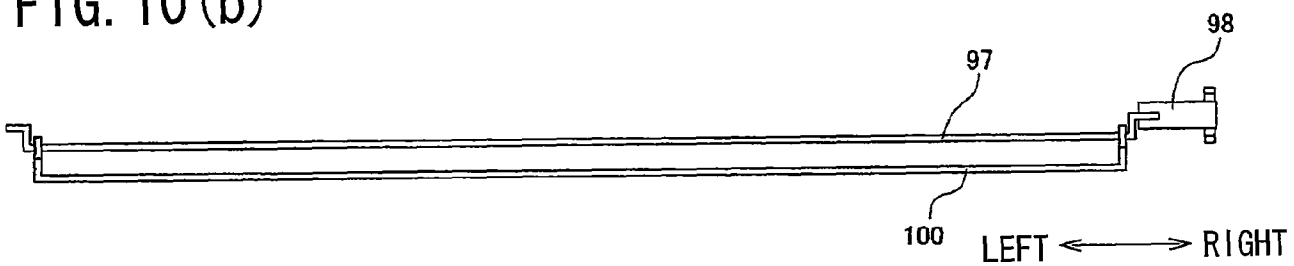

Further, as illustrated in FIGS. 10(*a*) and 10(*b*), a slide member 100 that is substantially U-shaped may be supported at end portions of a circulation part of the crankshaft 97 so as to be relatively rotated. In this case, the crankshaft 97 is rotated, as well as the slide member 100 is slid in the front-rear direction so as to agitate the toner in the supply roller housing portion 47.

In the above embodiment, the contacting member 74 of the layer-thickness regulating blade 19 is formed of a conductive resin. Alternatively, the contacting member 74 may be formed of a metal plate spring (conductive elastic body).

What is claimed is:

1. A developing apparatus comprising:

a housing including: a developer accommodating frame configured to accommodate developer; and a developing frame communicated with the developer accommodating frame, the developing frame including a supply-roller accommodating part and a bottom wall;

a developing roller rotatably supported by the supply-roller accommodating part and having a peripheral surface configured to carry the developer, the peripheral surface extending in an axial direction and including an axial end part;

a supply roller rotatably supported in the developing frame, contacting the developing roller at a first nip position, and configured to supply the toner to the developing roller, the supply roller being shorter than the developing roller;

a thickness regulating member including a contact member contacting the developing roller, the contact member being configured to regulate a thickness of the developer on the developing roller;

a sealing member located in the developing frame and having a first part contacting the axial end part and a second part including a first side surface; and a restricting member located in the developing frame, wherein the supply roller includes:

a rotational shaft extending in the axial direction, and having axial ends supported by the developing frame; and a roller body including: a contact surface that contacts the peripheral surface and covers the rotational shaft while exposing the both axial ends of the rotational shaft; and a second side surface located at an end of the contact surface in the axial direction, wherein the restricting member has a one side and another side opposite to the one side, the one side of the restricting member being opposed to the second side surface of the supply roller in the axial direction, the another side of the restricting member being opposed to the first side surface in the axial direction with a gap, wherein the gap is communicated with an interior space of the developer accommodating frame such that the developer is capable of moving away from the first nip position toward the bottom wall in the gap.

2. The developing apparatus according to claim 1, wherein the first part of the sealing member is formed of non-woven cloth.

3. The developing apparatus according to claim 1, wherein the second part of the sealing member is formed of resin foam.

4. The developing apparatus according to claim 1, wherein the restricting member is located further apart from the axial end part than the first nip position, wherein the restricting member restricts the developer, which falls to the gap from the first nip position, from moving to the supply roller.

5. The developing apparatus according to claim 1, wherein the restricting member includes a restricting wall extending from the bottom wall, the restricting wall preventing the developer from moving to the second side surface of the supply roller.

6. The developing apparatus according to claim 1, wherein the restricting member includes are a restricting wall, the restricting wall being formed with a through hole through which the rotational shaft is inserted.

7. The developing apparatus according to claim 1, wherein the developer includes developer particles having a mean volume diameter;

wherein the contact member contacts the peripheral surface, the contact member being configured to regulate a thickness of the developer on the peripheral surface such that an average of the thickness of the developer on the peripheral surface becomes smaller than or equal to the mean volume diameter;

wherein the developing roller rotates in a rotational direction; and wherein the peripheral surface of the developing roller has a region, the contact member having a thickness being larger than a thickness of the developer on the region, the thickness of the developer on the region being larger than the mean volume diameter.

8. The developing apparatus according to claim 7, wherein when the developing roller rotates in the rotational direction, the peripheral surface of the developing roller contacts the contact member at a second nip position such that the peripheral surface of the developing roller passes upward the second nip position.

9. The developing apparatus according to claim 8, wherein the supply roller is located below the developing roller and contacts the developing roller at the first nip position, the first nip position being located below the second nip position.

10. The developing apparatus according to claim 9, wherein the housing accommodates the developer below the first nip position.

11. The developing apparatus according to claim 8, wherein the contact member has a lower surface facing downward, the lower surface forming an angle larger than 90° relative to a tangent line of the developing roller at the second nip position.

12. The developing apparatus according to claim 8, wherein the region is located upstream of the second nip position in the rotational direction.

* * * * *